United States Patent [19]

Lin

[11] Patent Number: 4,883,013

[45] Date of Patent: Nov. 28, 1989

[54] PORTABLE, RAPID INSTALLABLE DOLPHIN SYSTEM

[75] Inventor: Sheng S. Lin, Camarillo, Calif.

[73] Assignee: The United States of America as represented by the Secretary of the Navy, Washington, D.C.

[21] Appl. No.: 345,339

[22] Filed: May 1, 1989

[51] Int. Cl.[4] ..... E02B 3/22

[52] U.S. Cl. ..... 114/219; 405/212; 405/215

[58] Field of Search ..... 114/219, 220, 264, 266, 114/267; 405/195, 202, 203, 205, 207, 211–216

[56] References Cited

U.S. PATENT DOCUMENTS

| | | | |
|---|---|---|---|
| 3,564,858 | 2/1971 | Pogonowski | 114/219 |
| 3,572,045 | 3/1971 | Oweri | 114/219 |
| 4,309,956 | 1/1982 | Tamaguchi | 114/219 |
| 4,446,806 | 5/1984 | Loire | 114/219 |
| 4,817,552 | 4/1989 | Poldervaart | 114/219 |
| 4,817,555 | 4/1989 | Meineri | 114/219 |

*Primary Examiner*—Joseph F. Peters, Jr.
*Assistant Examiner*—Clifford T. Bartz
*Attorney, Agent, or Firm*—David S. Kalmbaugh; J. M. St. Amand

[57] ABSTRACT

A portable rapidly installable dolphin system comprising a gravity base with a skirt which may be ballasted or deballasted at a site of interest. A pair of fenders are mounted vertically on a rectangular shaped plate which has a pair of legs connected in rotational engagement to the gravity base. The fenders function to transmit a moored vessel's load to the gravity base. Activating an air operated cylinder mounted within the gravity base will effectuate the movement of the plate's support structure so as to cause the plate to rise from a first position which is parallel to and above the gravity base to a second position which is perpendicular to and above the gravity base. Six propellant embedment anchors hold the dolphin in place.

14 Claims, 4 Drawing Sheets

PORTABLE, RAPID INSTALLABLE DOLPHIN SYSTEM

BACKGROUND OF THE INVENTION

1. Field of the Invention

This invention relates generally to moorings for ocean going vessels. In particular, this invention relates to a portable dolphin system which is rapidly installable and retrievable for reuse.

2. Description of the Prior Art

In the prior art there are several marine structures which are designed to resist ship berthing loads. Driven pile clusters usually made of wood, concrete or steel are used to protect piers, docks and wharfs. The number of piles in a cluster ranges from 3 to 19. The driven pile cluster is suitable for soils such as dense sand or hard clays but is not suitable on soft sediments.

To resist large ship loads such as those resulting from oil tankers, cellular sheet pile walls filled with granular materials have been used. On mud or a soft clay sea floor, the piles must be driven to great depths to insure proper lateral resistance. In addition, the sheet pile wall cannot be driven into hard coral or rock.

A third type of dolphin is a closed box concrete caisson which is pre-fabricated, towed to a designated site and ballasted with sea water. For a permanent installation, a layer of gravel or crushed rock is placed on the sea floor prior to placement of the caisson. However, the concrete box caisson is very heavy and bulky.

SUMMARY OF THE INVENTION

The subject invention overcomes some of the disadvantages of the prior art, including those mentioned above, in that it comprises a relatively simple portable dolphin system, which may be rapidly deployed so as to provide a mooring for ocean going vessels.

Included in the present invention is a gravity base with a skirt which may be ballasted or deballasted at a site of interest. The gravity base spreads the load created by a vessel over a large area so as to reduce base settlement particularly on mud or soft clay. A pair of vertically positioned doughnut shaped fenders mounted on the portable dolphin's superstructure transmit the vessel's load to the gravity base. Six propellant embedment anchors hold the dolphin in place. By activating a docking cylinder the dolphin's superstructure is brought from a collapsed position to a fully operational position within 48 hours. Deactivation of the docking cylinder allows the superstructure to be folded down to reduce shipping volume during transportation.

DESCRIPTION OF THE PREFERRED EMBODIMENT

Figure 1:
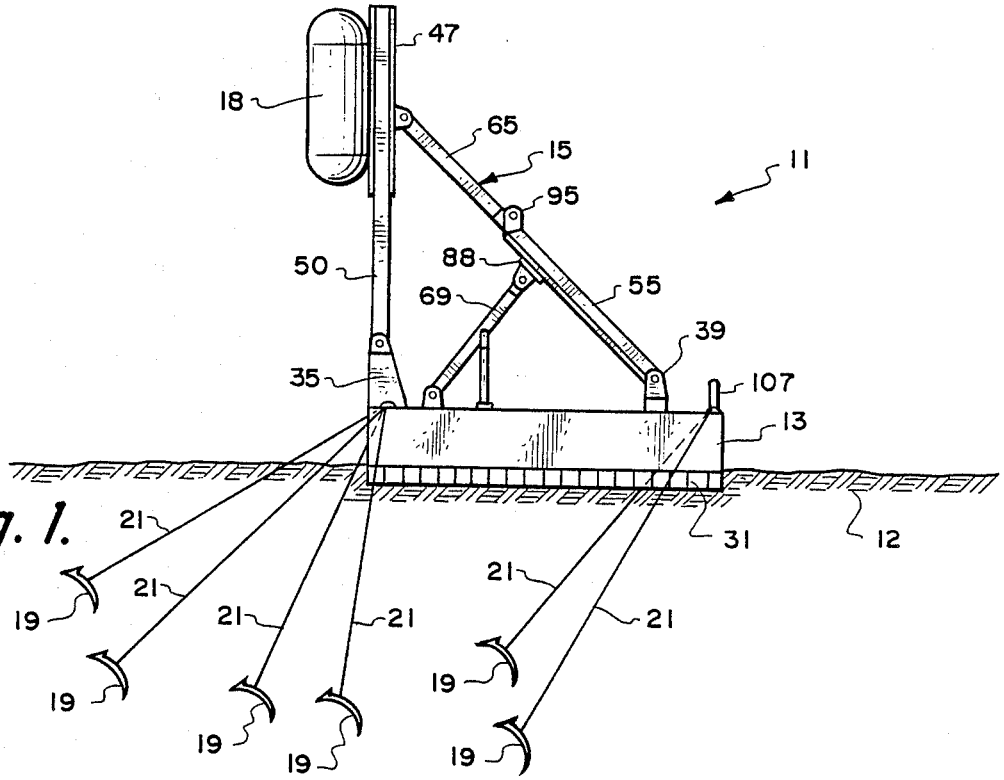
FIG. 1 is a side view of the portable dolphin system when fully deployed.

The preferred embodiment of the subject invention will now be discussed in conjunction with all of the figures of the drawing wherein like parts are designated by like reference numerals insofar as it is possible and practical to do so.

Figure 2:
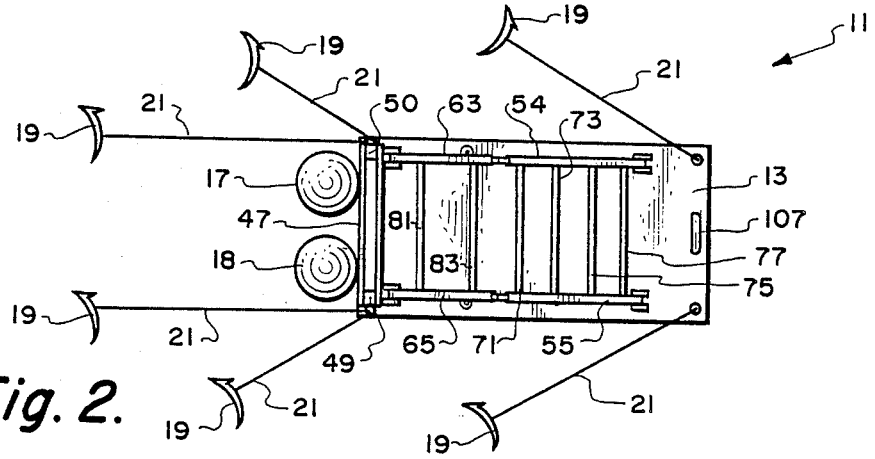
FIG. 2 is a top view of the portable dolphin system.

Referring first to FIGS. 1 and 2, there is shown in operational deployment a gravity based dolphin system 11 anchored to the ocean floor 12. Gravity based dolphin system 11 has a rectangular shaped gravity base 13, a fender support superstructure 15 mounted to base 13, and a pair of doughnut-shaped fenders 17 and 18 mounted vertically at the top of fender support superstructure 15. Fenders 17 and 18 may be fabricated from rubberized compounds.

Gravity based dolphin system 11 utilizes six propellant embedment anchors 19 to provide both horizontal and vertical uplift resistances and thereby hold gravity based dolphin system 11 in place.

Figure 3:
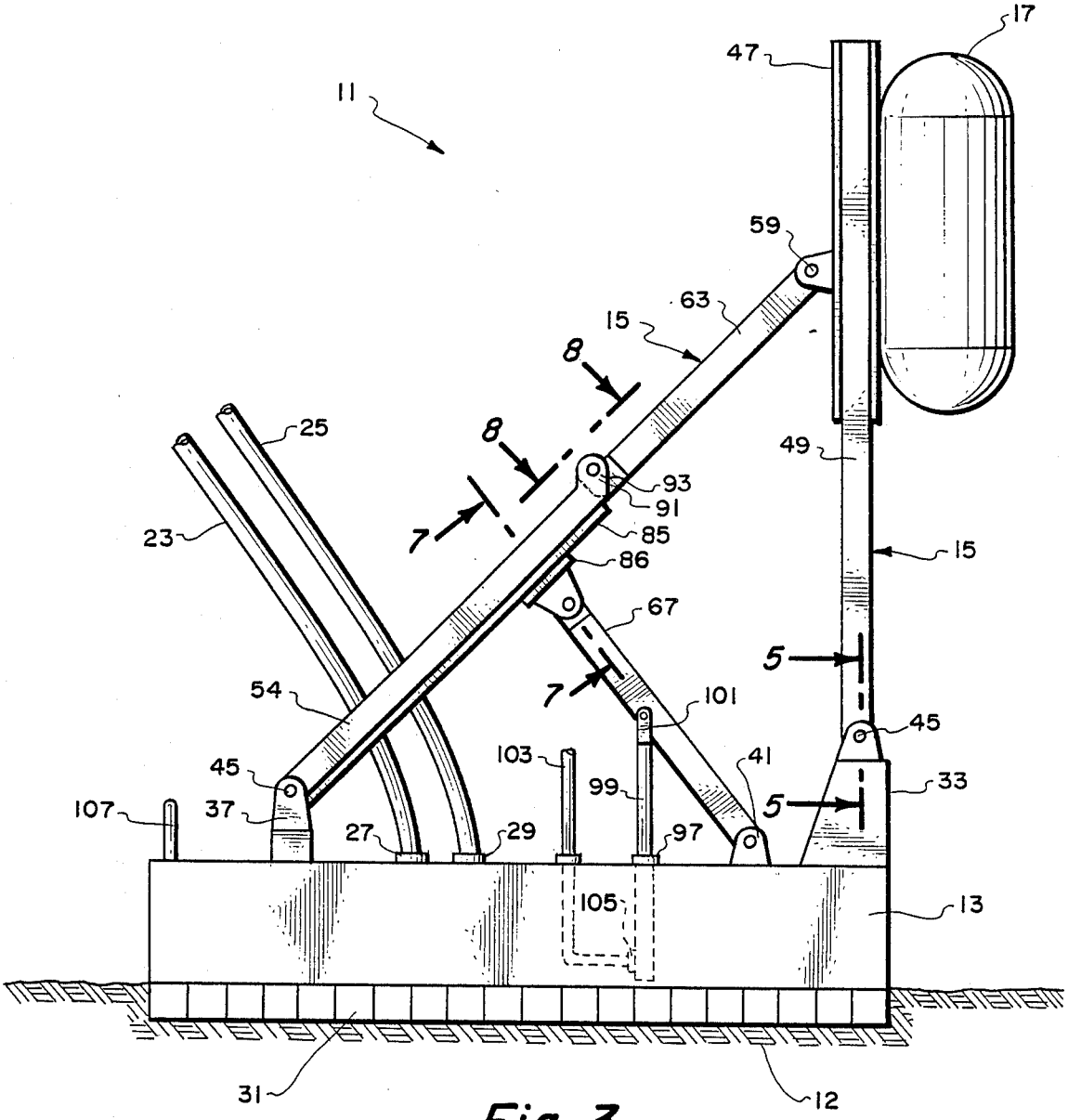
FIG. 3 is a detailed side view of the portable dolphin system.

Each of the anchors 19 is connected to a corner of gravity base 13 by a load line 21 which may be a rope or a chain. Although any anchor may be used with gravity based dolphin system 11, it was found that system 11 functioned very well with anchors of the type described in U.S. Pat. No. 3,910,218 entitled "Propellant-Actuated Deep Water Anchor" to Robert J. Taylor and Richard M. Beard Referring now to FIGS. 1, 3 and 4, there is shown gravity base 13 which may be a hollow steel structure made of compartmentalized tanks, not shown. In the preferred embodiment, gravity base 13 measures 30 feet wide by 60 feet long by 10 feet deep and can be ballasted or deballasted with sea water provided by a pump, not shown, through a pair of hoses 23 and 25 connected to an inlet port 27 and an outlet port 29 located on the upper surface of gravity base 13. When gravity base 13 is deployed on ocean floor 12, gravity base 13 spreads the force exerted by an ocean going vessel, not shown, over a large area thereby reducing base settlement, particularly for a dolphin system which may be deployed on soft clay. In general, base settlement will be minimal when gravity based dolphin system 11 is deployed on silt, sand, gravel, coral, or rock.

Figure 5:
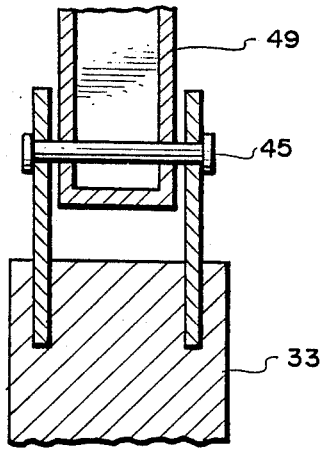
FIG. 5 is a frontal view of a bracket used on the portable dolphin system taken along line 5—5 of FIG. 3.

Located on the bottom surface of gravity base 13 and attached thereto is a steel skirt 31, which in the preferred embodiment is three feet high. Steel skirt 31 functions to mobilize soil resistance against sliding when gravity base 13 is deployed on clay or silt; and to reduce scour damage around the perimeter of gravity base 13 when base 13 is deployed on sand or silt. Affixed to the upper surface of gravity base 13 by bolts, not shown, are support brackets 33, 35, 37, 39, 41 and 43. Since each support bracket is identical, only support bracket 33 will be discussed. As shown in FIG. 5, support bracket 33 has a rod 45, which allows the various support elements of fender support superstructure 15 to be in rotational engagement with gravity base 13.

Figure 6:
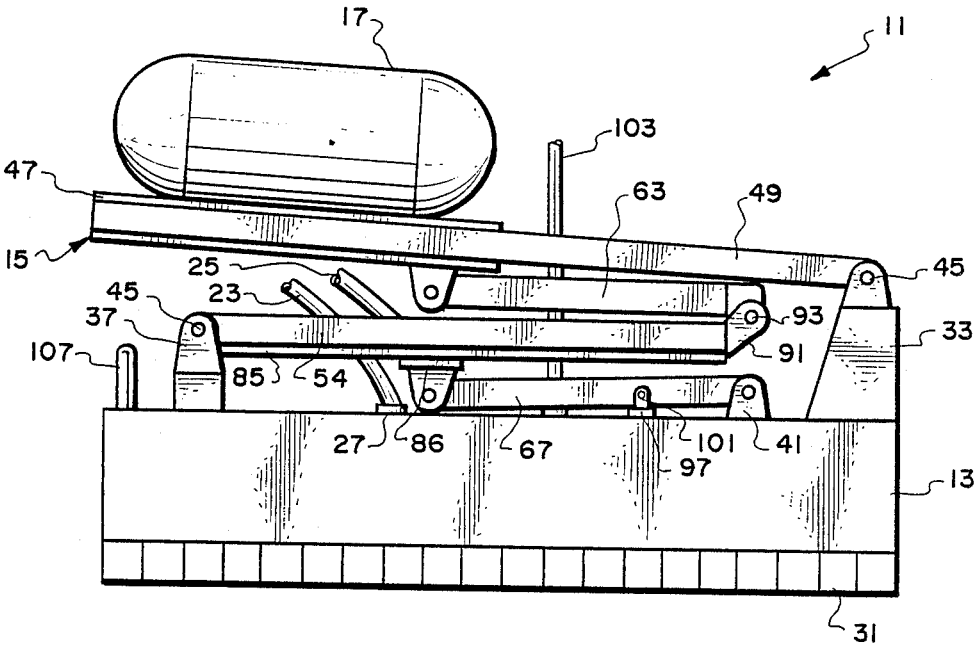
FIG. 6 is a side view of the portable dolphin system when the system is folded

Referring again to FIGS. 1, 3 and 4, fender support superstructure 15 includes a rectangular shaped plate 47 having a pair of legs 49, and 50 extending from the bottom edge thereof Leg 49 has an aperture, not shown, which allows rod 45 of bracket 33 to pass therethrough. In a similar manner, rod 45 of bracket 35 passes through an aperture in leg 50. This arrangement allows plate 47 to be in rotational engagement with base 15 such that plate 47 is perpendicular to base 13 when dolphin system 11 is fully operational. Similarly, when dolphin system 11 is not in use, plate 47 will be in an almost parallel position and resting upon the upper surface of base 13 as shown in FIG. 6.

Mounted to plate 47 in a vertical position are fenders 17 and 18. Fenders 17 and 18 may be secured to plate 47 by chains or rope, not shown. In the preferred embodiment, fenders 17 and 18 are up to 30 feet in diameter and 15 feet in length with an energy absorption of up to 2500 foot kips, which exceeds the design berthing impact energy of 400 foot kips for dolphin system 11. In addition, it should be noted that the upper end of fenders 17 and 18 is approximately 70 feet above ocean floor 12 in the preferred embodiment. In addition, it should be noted that fenders 17 and 18 were manufactured by Seaward International, Inc of Clearbrook, Va. which uses the trademark Sea Guard Marine Fenders to designate their fenders.

Positioned between legs 49 and 50 and attached thereto is a horizontal support member 51, and diagonal support members 52 and 53, which stabilize legs 49 and 50. Members 51, 52, and 53 were fabricated from steel and may be attached to legs 49 and 50 by welds.

Fender support superstructure 15 also includes lower support bracings 54 and 55 each of which has an aperture such that rods 45 of brackets 37 and 39 pass through the apertures, so as to allow lower support bracings 54 and 55 to be in rotational engagement with gravity base 13. When dolphin system 11 is fully deployed, lower support bracings 54 and 55 form an angle of approximately 45 degrees with the upper surface of base 13.

Plate 47 has affixed to the back surface thereof by bolts, not shown, brackets 59 and 61 which are identical to the bracket illustrated in FIG. 5. A pair of upper support bracings 63 and 65 are secured to the back side of plate 47 by brackets 59 and 61 which allow bracings 63 and 65 to be in rotational engagement with plate 47 When dolphin system 11 is fully deployed, bracings 63 and 65 form an angle of approximately 45 degrees with the back side of plate 47.

A pair of diagonal support bracings 67 and 69 are secured to base 13 by brackets 41 and 43 which allows bracings 67 and 69 to be in rotational engagement with base 13. When dolphin system 11 is fully deployed bracings 67 and 69 form an angle of approximately 54 degrees with the upper surface of base 13.

In the preferred embodiment bracings 54, 55, 63, 65, 67 and 69 were fabricated from 12 inch by 12 inch by ½ inch steel tubing with bracings 54 and 55 being 37 feet 1.75 inches in length, bracings 63 and 65 being 30 feet 4.375 inches in length, and bracings 67 and 69 being 29 feet 6.125 inches in length.

Figure 4:
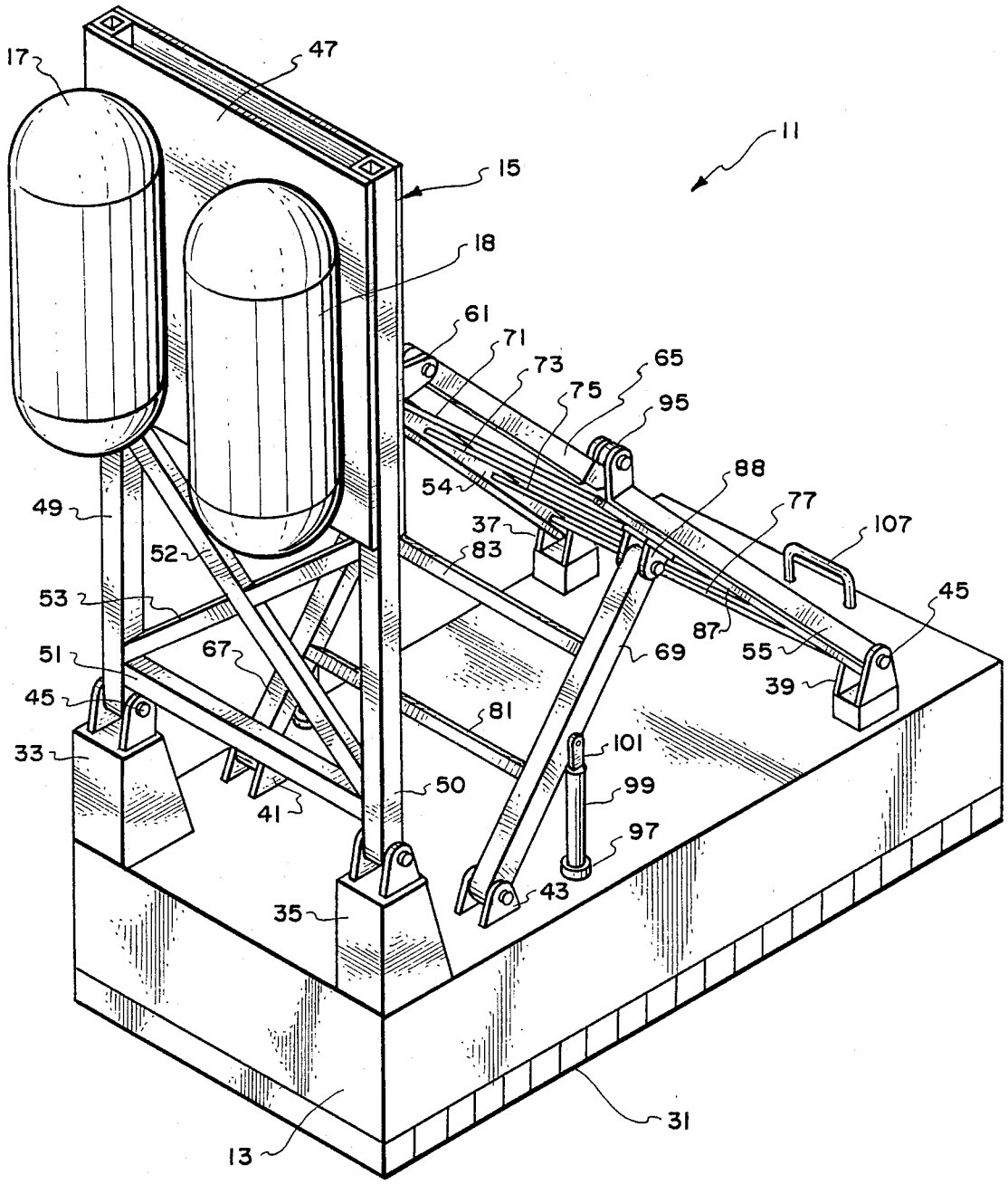
FIG. 4 is a detailed perspective of the portable dolphin system.

Positioned between and attached to lower support bracings 54 and 55 are four cross support bracings 71, 73, 75 and 77, as shown in FIGS. 2 and 4, which stabilize bracings 54 and 55. Similarly positioned between and attached to diagonal support bracings 67 and 69 are a pair of cross support bracings 81 and 83 which stabilize bracings 67 and 69. In the preferred embodiment each cross bracing was fabricated from tubular steel and was attached to the lower or diagonal support bracing by a weld.

Figure 7:
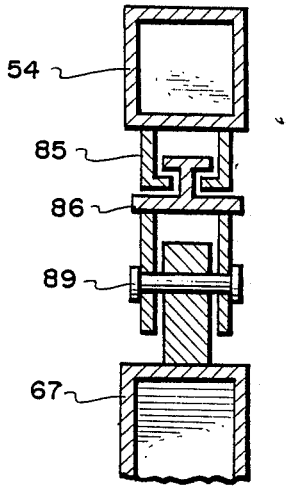
FIG. 7 is a cross-sectional view of an elongated guide channel and movable support bracket used on the portable dolphin system taken along line 7—7 of FIG. 3.

Attached to the bottom side of lower support bracing 54 is an elongated guide channel 85 which has a movable support bracket 86 mounted to slide within guide channel 85 between the ends thereof. Similarly, attached to the bottom side of lower support bracing 55 is an elongated guide channel 87 which has a movable support bracket 88 mounted to slide within guide channel 87 between the ends thereof As shown in FIG. 7, guide channel 85 is generally U shaped, may be fabricated from steel and is attached to bracing 54 by means of a weld. The bottom portion of movable support bracket 86 is I shaped so as to allow bracket 86 to slide within channel 85. The top portion of bracket 86 has a rod 89 which allows diagonal bracing 67 to be in rotational as well as slidable engagement with bracing 54. Similarly, bracket 88 allows bracing 69 to be in rotational as well as slidable engagement with bracing 55.

Figure 8:
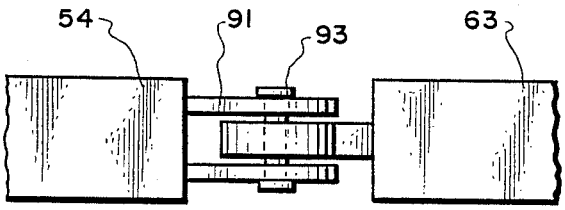
FIG. 8 is the top of a rotational joint between a lower and upper support bracing on the dolphin's superstructure taken along line 8—8 of FIG. 3.

Referring now to FIG. 8, there is shown an angled bracket 91 which is attached to the upper end of bracing 54 and has a rod 93 which passes through an aperture located at the lower end of bracing 63. This arrangement allows bracing 63 to be in rotational engagement with bracing 54. Similarly, bracing 55 has attached to the upper end thereof an angled bracket 95 which allows bracing 65 to be in rotational engagement with bracing 55. When dolphin system 11 is deployed bracings 54 and 63 will form a first continuous support element for plate 47, while bracings 55 and 65 will form a second continuous support element for plate 47.

Referring again to FIG. 3, there is shown a docking cylinder 97 having a drive member 99. Docking cylinder 97 is mounted within the upper surface of base 13. Bracing 67 has a bracket 101 attached thereto at approximately the midpoint thereof, which is identical to the bracket illustrated in FIG. 5. Bracket 101 allows drive member 99 to be in rotational engagement with bracing 67. Docking cylinder 97 may be an air operated cylinder which is activated by a source of air, not shown, supplied through an air hose 103, connected to an inlet port 105 on cylinder 97.

Located on the upper surface and the rear of base 13 and attached thereto is a U shaped element 107. Element 107 provides a means whereby a hook from a tow line may be placed on dolphin system 11 when system 11 is being towed.

The operation of the invention will now be discussed in conjunction with all of the figures of the drawing.

Referring now to FIGS. 1 through 6, there is first shown by FIG. 6 gravity base dolphin system 11 when dolphin system 11 is being towed to a designated site As shown in FIG. 6, plate 47 of dolphin system 11 and fenders 17 and 18 are almost parallel to and resting upon the upper surface of base 13. When dolphin system 11 arrives at the designated site, sea water is pumped through inlet port 27 into the compartmentalized tanks of gravity base 13. As sea water is added to base 13 above a 6.5 foot ballast height, dolphin system 11 will gradually sink to ocean floor 12 Propellant anchors 19 are then activated in the manner described in U.S. Pat. No. 3,910,218 and positioned as shown in FIGS. 1 and 2 By ballasting and the use of propellant anchors 19, forces derived from ocean currents and waves which would normally cause dolphin system 11 to tilt and drift are eliminated.

When gravity base 13 has settled on ocean floor 12, air is pumped through inlet port 105 of docking cylinder 97 causing drive member 99 to raise diagonal bracings 67 and 69 from a collapsed position as shown in FIG. 6 to an operational position as shown in FIG. 4 The raising of diagonal support bracings 67 and 69 will cause lower support bracings 54 and 55 and upper support bracings 63 and 65 to rise from a collapsed position as shown in FIG. 6 to an operational position as shown in FIG. 4 This movement of bracings 54, 55, 63, 65 67, and 69 will then cause plate 47 to rise from a collapsed position as shown in FIG. 6 to an operational position as shown in FIG. 4. It should be noted at this time that the time required to make dolphin system 11 operational is approximately 48 hours.

In a similar manner, dolphin system 11 may be inactivated by releasing air from docking cylinder 97, thereby causing superstructure 15 to collapse as shown in FIG. 6. Base 13 is then deballasted by pumping water from the compartmentalized tanks of base 13 through outlet port 29. This allows dolphin system 11 to be taken to a new site for redeployment Obviously many modifications and variations of the present invention are possible in the light of the above teachings. It is therefore to be understood that within the scope of the appended claims, the invention may be practiced otherwise than as specifically described

What is claimed is:

1. A portable rapidly installable dolphin system for absorbing forces of impact from a moored floating vessel comprising:

a. a hollow rectangular shaped gravity base having an upper and bottom surface;

b. a skirt having an upper surface attached to the bottom surface of said gravity base;

c. a rectangular shaped plate having a front and a back surface and a pair of vertical legs extending from the bottom edge thereof, each of said legs being connected in rotational engagement to the upper surface of said gravity base near the front end thereof;

d. means mounted on the front surface of said plate for absorbing forces of impact from said moored floating vessel;

e. a plate support structure having one end thereof connected in rotational engagement to the back surface of said plate and the opposite end thereof connected in rotational engagement to the upper surface of said gravity base near the rear end thereof;

f. actuating means mounted within the upper surface of said gravity base, said actuating means having a drive member connected in rotational engagement to said plate support structure near the center thereof; and g. said actuating means adapted to effectuate the movement of said plate support structure so as to raise said plate from a first position which is above and approximately parallel to the upper surface of said gravity base to a second position which is above and approximately perpendicular to the upper surface of said gravity base.

2. The dolphin system as recited in claim 1 wherein said force absorbing means comprises a pair of fenders vertically mounted on the front surface of said plate.

3. The dolphin system as recited in claim 1 wherein said plate support structure comprises:

a. first and second lower support bracings, each of which has one end thereof connected in rotational engagement to the upper surface of said gravity base near the rear end thereof;

b. first and second upper support bracings, each of which has one end thereof connected in rotational engagement to the back surface of said plate and the opposite end thereof connected in rotational engagement to one of said lower support bracings at the end opposite said end connected to the upper surface of said gravity base; and c. first and second diagonal support bracings, each of which has one end thereof connected in rotational engagement to the upper surface of said gravity base and the opposite end thereof connected in rotational and slidable engagement to one of said lower support bracings.

4. The dolphin system as recited in claim 1 wherein said actuating means comprises an air operated cylinder mounted within the upper surface of said gravity base.

5. The dolphin system as recited in claim 1 further characterized by an inlet port located on the upper surface of said gravity base, said inlet port adapted to receive sea water for said gravity base and thereby ballast said gravity base.

6. The dolphin system as recited in claim 1 further characterized by an outlet port located on the upper surface of said gravity base, said outlet port adapted to allow sea water to egress from said gravity base and thereby deballast said gravity base.

7. The dolphin system as recited in claim 1 further characterized by a U shaped element located on the upper surface near the rear of said gravity base.

8. The dolphin system as recited in claim 1 further characterized by six propellant embedment anchors, each of which has a tow line to connect said anchor to said gravity base.

9. A dolphin structure adapted to absorb loading forces a. a hollow rectangular shaped gravity base having an upper and bottom surface;

b. a skirt having an upper surface attached to the bottom surface of said gravity base;

c. a rectangular shaped plate having a front and a back surface and a pair of vertical legs extending from the bottom edge thereof, each of said legs being connected in rotational engagement with the upper surface of said gravity base near the front end thereof;

d. a pair of fenders mounted vertically on the front surface of said plate, said fenders adapted to absorb loading forces from said moored floating vessel;

e. first and second lower support bracings, each of which has one end thereof connected in rotational engagement to the upper surface of said gravity base near the rear end thereof;

f. first and second upper support bracings, each of which has one end thereof connected in rotational engagement to the back surface of said plate and the opposite end thereof connected in rotational engagement to one of said lower support bracings at the end opposite said end connected to the upper surface of said gravity base;

g. first and second diagonal support bracings, each of which has one end thereof connected in rotational engagement to the upper surface of said gravity base and the opposite end thereof connected in rotational and slidable engagement to one of said lower support bracings;

h. an air operated cylinder mounted within the upper surface of said gravity base, said air operated cylinder having a drive member connected in rotational engagement to one of said diagonal support bracings near the center thereof;

i. said air operated cylinder adapted to effectuate the movement of said first and second lower, upper, and diagonal support bracings so as to raise said plate from a first position which is above and approximately parallel to the upper surface of said gravity base to a second position which is above and approximately perpendicular to the upper surface of said gravity base;

j. an inlet port located on the upper surface of said gravity base, said inlet port adapted to receive sea water for said gravity base and thereby ballast said gravity base; and k. an outlet port located on the upper surface of said gravity base, said outlet port adapted to allow sea water to egress from said gravity base and thereby deballast said gravity base.

10. The dolphin structure as recited in claim 9 further characterized by a U shaped element located on the upper surface near the rear of said gravity base.

11. The dolphin structure as recited in claim 9 further characterized by six propellant embedment anchors, each of which has a tow line to connect said anchor to said gravity base.

12. The dolphin structure as recited in claim 9 further characterized by a pair of diagonal support members and a horizontal support member positioned between said legs.

13. The dolphin structure as recited in claim 9 further characterized by a plurality of cross support bracings positioned between said lower support bracings.

14. The dolphin structure as recited in claim 9 further characterized by a plurality of cross support bracings positioned between said diagonal support bracings.

* * * * *